US007052257B2

(12) United States Patent
Bodzak

(10) Patent No.: US 7,052,257 B2
(45) Date of Patent: May 30, 2006

(54) INTERNAL GEAR PUMP

(75) Inventor: Stanislaw Bodzak, Elsbethen (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/450,462

(22) PCT Filed: Jul. 13, 2002

(86) PCT No.: PCT/DE02/02577

§ 371 (c)(1),
(2), (4) Date: Jun. 10, 2004

(87) PCT Pub. No.: WO03/036091

PCT Pub. Date: May 1, 2003

(65) Prior Publication Data

US 2004/0219038 A1 Nov. 4, 2004

(30) Foreign Application Priority Data

Oct. 13, 2001 (DE) ..... 101 50 653

(51) Int. Cl.
*F04C 18/00* (2006.01)

(52) U.S. Cl. ..... 418/171; 418/109

(58) Field of Classification Search ..... 418/69, 418/109, 130, 132, 133, 166, 171; 464/102
See application file for complete search history.

(56) References Cited

U.S. PATENT DOCUMENTS

| | | | | |
|---|---|---|---|---|
| 1,497,050 | A | 6/1924 | Wardwell | |
| 3,536,426 | A | 10/1970 | Albrecht | |
| 4,156,585 | A | 5/1979 | Ross | |
| 4,264,288 | A | 4/1981 | Wuesthof | |
| 5,145,348 | A * | 9/1992 | Zumbusch | 418/171 |
| 6,074,189 | A * | 6/2000 | Eckerle | 418/109 |
| 6,676,394 | B1 * | 1/2004 | Bodzak | 418/171 |

FOREIGN PATENT DOCUMENTS

| | | |
|---|---|---|
| CH | 262 067 | 6/1949 |
| DE | 590 394 | 12/1933 |
| DE | 28 14 659 | 10/1979 |
| DE | 82 26 081 U1 | 2/1984 |
| DE | 3827573 A * | 2/1990 |
| DE | 196 51 683 A1 | 6/1998 |
| DE | 100 35 900 | 1/2002 |
| JP | 62048977 | 3/1987 |
| JP | 06249155 A * | 9/1994 |

* cited by examiner

*Primary Examiner*—Theresa Trieu
(74) *Attorney, Agent, or Firm*—Ronald E. Greigg

(57) ABSTRACT

The invention relates to an internal gear pump for delivering fuel in an internal combustion engine, with an internally toothed annular gear and an externally toothed pinion that cooperates with the annular gear to produce a pumping action. In order to increase both the delivery capacity at starting speed and the service life of the internal gear pump, the pinion is supported on a supporting stub in a radially mobile fashion, eccentric to the annular gear. In addition, a device is provided to compensate for the radial play between the pinion and the annular gear. The drive is transmitted by a spring-loaded Oldham coupling, which adjusts the axial play of the pump according to the invention.

13 Claims, 3 Drawing Sheets

INTERNAL GEAR PUMP

CROSS-REFERENCE TO RELATED APPLICATIONS

This application is a 35 USC 371 application of PCT/DE 02/02577 filed on Jul. 13, 2002.

BACKGROUND OF THE INVENTION

1. Field of the Invention
2. Description of the Prior Art

An internal gear pump of the above type is also referred to as an annular gear pump. The annular gear and the pinion represent the pump elements and are also referred to as the outer rotor and the inner rotor. DE 38 27 573 A1 has disclosed an internal gear pump whose annular gear is driven by an electric motor. The delivery chambers disposed between the teeth of the two pump elements of the internal gear pump are covered in the axial direction by a thrust washer. A helical spring embodied as a compression spring, which is prestressed against the thrust plate, assures that axial play is equal to zero during the starting of the internal combustion engine. Between the electric motor and the annular gear, an Oldham coupling is provided, which can compensate for an axial offset between the pump and the electric motor.

OBJECT AND SUMMARY OF THE DESCRIPTION

The object of the invention is to increase both the delivery capacity at starting speed and the service life of the internal gear pump described at the beginning. In addition, the internal gear pump according to the invention should be inexpensive to produce.

This object is attained in an internal gear pump for delivering fuel in an internal combustion engine, with an internally toothed annular gear and an externally toothed pinion that cooperates with the annular gear to produce a pumping action in that the pinion is supported eccentric to the annular gear on a supporting stub and is supported in a radially mobile fashion, and in that a device is provided to compensate for the radial play between the pinion and the annular gear, particularly during starting of the internal combustion engine.

During the starting of the internal combustion engine, the pressure in the internal gear pump is equal to zero. A spring device according to the invention compensates for the tip play between two teeth of the pump elements whose tips contact each other during the starting of the internal combustion engine. After the idle speed has been reached, the pump pressure increases and acts in opposition to the spring force. This causes the tip play between the annular gear and the pinion to increase, as a result of which the delivery capacity decreases; the tribological conditions in the pump are improved through an increase in the tip play.

A particularly simple and effective embodiment of the device according to the invention is comprised of a lateral bore in the supporting stub and a second compression spring contained in the lateral bore; the second compression spring is supported at least indirectly against the pinion. The spring force presses the pinion against the annular gear as long as the pressure in the inner chamber of the gear pump is low. This is particularly the case when the engine is not running and while the engine is being started, so that the desired play-free cooperation of the pinion and annular gear occurs automatically. The direction of the lateral bore determines the point at which the tooth tips of the pinion and the annular gear contact each other. It has turned out to be advantageous if the direction of the lateral bore lies between the suction chamber and the pressure chamber of the pump.

In order to minimize the wear between the pinion and the compression spring, another embodiment of the invention can include the provision of a thrust piece, in particular a sphere, between the second compression spring and the pinion so that no sliding friction occurs between the second compression spring and the pinion, but only rolling friction.

In order to be able to adapt the gear pump according to the invention to different internal combustion engines, it is possible to provide that the prestressing force of the second compression spring be adjustable. This can be achieved, for example, by placing spacer washers or other spherical diameters in the lateral bore.

Other variants of the invention include the provision that the annular gear is coupled to a coupling disk by means of an Oldham coupling or is coupled to a drive shaft by means of a radially elastic coupling so that a slight axial offset between the rotation axis of the annular gear and the drive shaft can also be compensated for and does not lead to impermissible strains on the internal gear pump.

It has turned out to be particularly advantageous if the coupling disk is pressed against the pinion and the annular gear by means of a first compression spring, in particular a first compression spring with an adjustable degree of prestressing, wherein the first compression spring can be disposed, for example, inside the end of the drive shaft. This simple measure always reduces the axial play of the internal gear pump according to the invention to zero, which has a positive effect on the delivery capacity at low speeds.

BRIEF DESCRIPTION OF THE DRAWINGS

The foregoing and other features and advantages of the invention will become apparent from the description contained herein below, taken in conjunction with the drawings, in which:

FIG. 1 shows a high-pressure pump 1 with an internal gear pump 2 attached to it. The internal gear pump 2 contains an externally toothed pinion 3 that is supported in rotary fashion on a supporting stub 5. The externally toothed pinion 3 is supported eccentric to an internally toothed annular gear 11.

Figure 1:
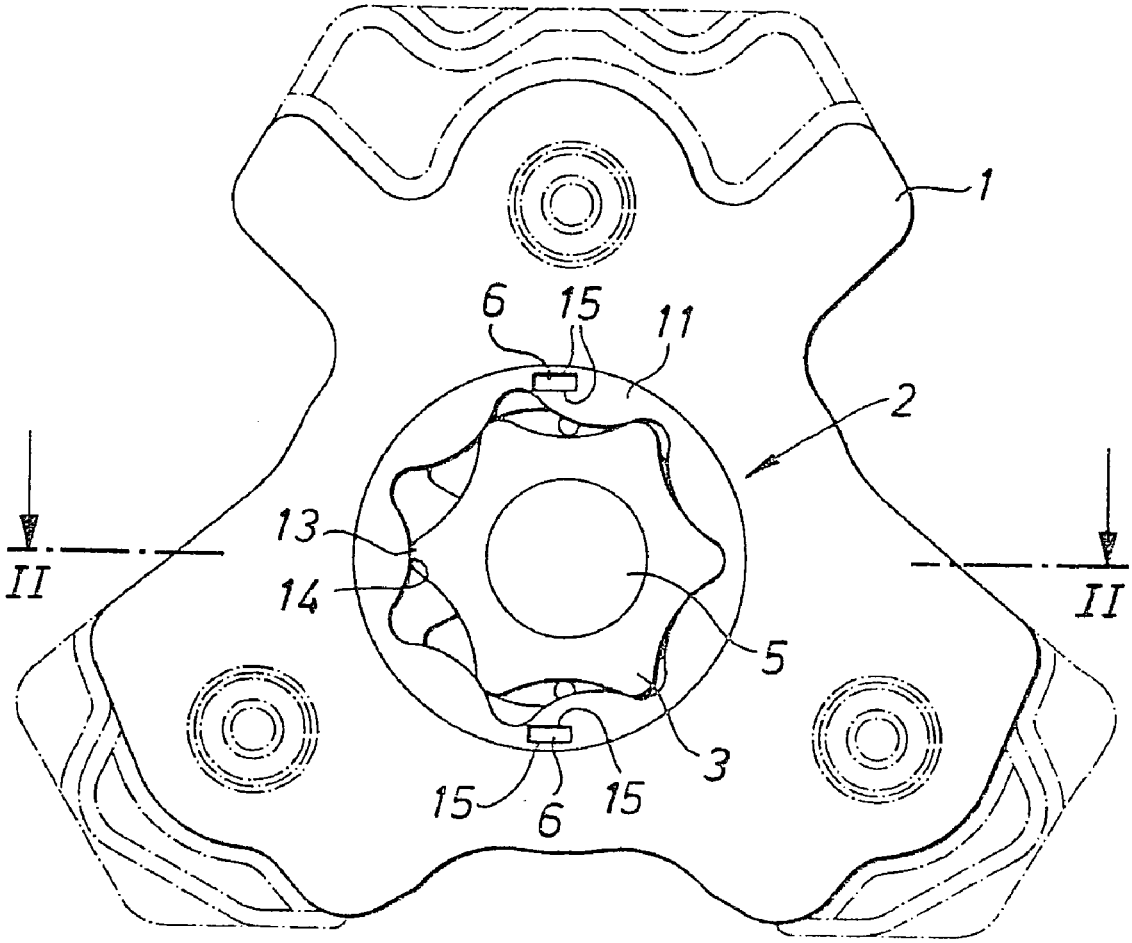
FIG. 1 shows a top view of an embodiment of the internal gear pump according to the invention, without the pump housing.

The annular gear 11 has two recesses 6 and 7 disposed on diametrically opposite sides, which are used to drive the annular gear by means of a drive shaft, not shown in the drawing, and an Oldham coupling that is also not shown.

In order to achieve the greatest possible delivery capacity of the gear pump a tooth tip 13 of the pinion 3 should be held in contact with a tooth tip 14 of the annular gear 11 during the starting of the engine. As soon as the engine has reached its idle speed, then the tooth tips 13 and 14 should lift away from each other in order to reduce the wear on them.

Figure 2:
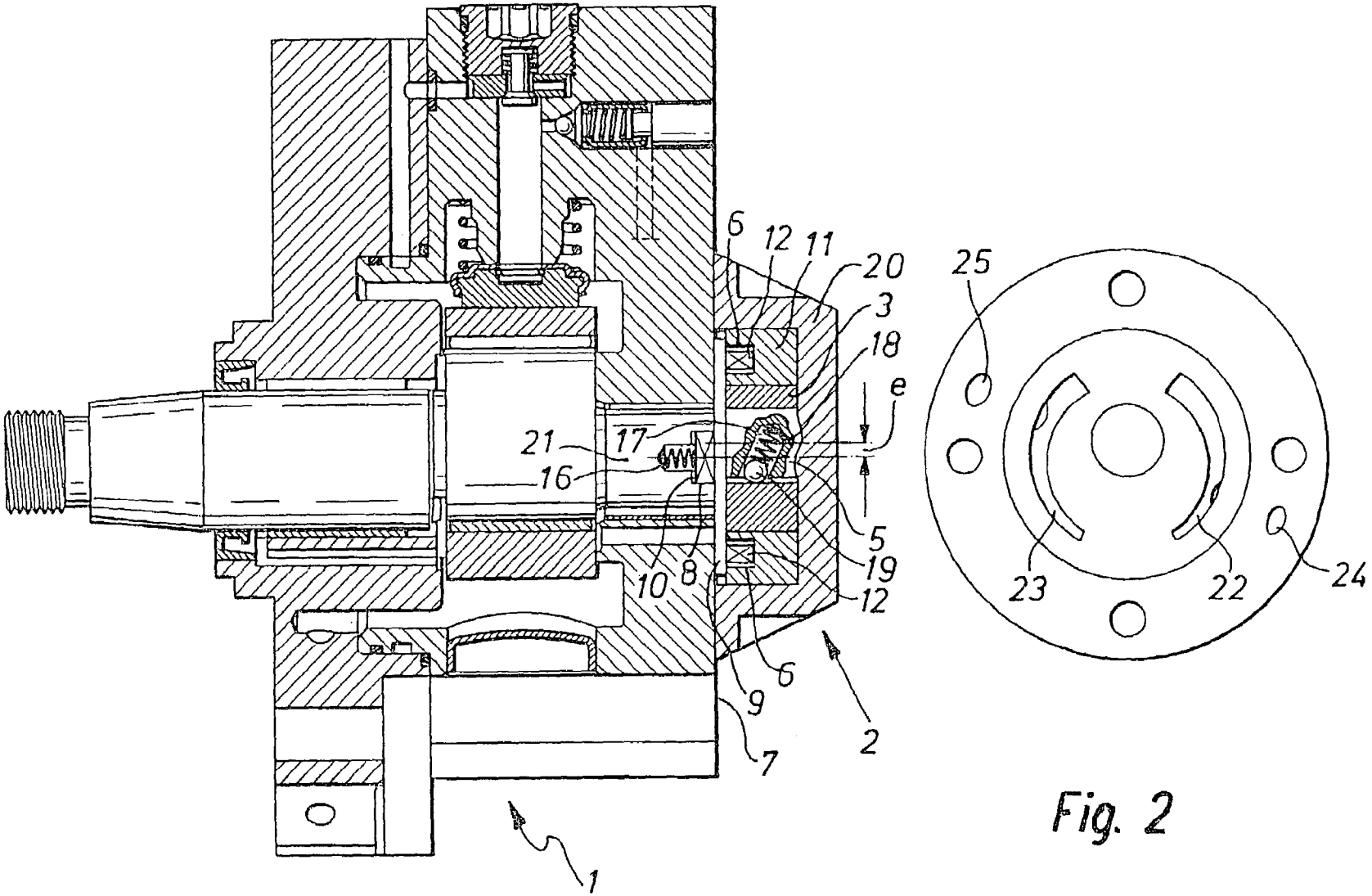
FIG. 2 shows the view of a section along the line II—II in FIG. 1.

A recess 8 is provided in the shaft end 21. The recess 8 has two side walls that are disposed parallel to each other and are not shown in FIG. 2. In the position of the shaft end 21 depicted in FIG. 2, these parallel side walls extend perpendicular to the plane of the drawing, and generally parallel to the axis of shaft end 21.

A coupling disk 9 protrudes with a two-edged element 10 into the recess 8. The parallel walls of the recess 8 and of the two-edged element 10 of the coupling disk 9 permit the torque required to drive the internal gear pump 2 to be transmitted from the shaft end 21 to the coupling disk 9.

On its side oriented away from the two-edged element 10, the coupling disk 9 has two projections 12, which engage in the recesses 6 of the annular gear 11. The recesses 6, as shown in FIG. 1, have two parallel side walls 15, which engage the edges of the projection 12 to drive the disc 9.

The recess 8, the coupling disk 9 with the two-edged element 10 and the projections 12, as well as the recesses 6 constitute a so-called Oldham coupling. Even in the presence of an axial offset, this coupling serves to transmit the rotary motion of the drive shaft end 21 to the annular gear 11 of the internal gear pump 2. As a result, the Oldham coupling makes it possible to compensate for an axial offset between the drive shaft end 21 and the rotation axis of the annular gear 11.

Inside the shaft end 21, a first compression spring 16 is provided, which is supported against the end of the shaft 21 at one end and against the two-edged element 10 at the other. This presses the coupling disk 9 against the annular gear 11 so that the internal gear pump 2 has no axial play toward the outside, at least when it is not running. There should be an axial play of e.g. 0.005 mm between the pinion 3 and the coupling disk 9 when the pump is being started.

A lateral bore 17, which contains a second compression spring 18 and a sphere 19, is provided in the supporting stub 5. The second compression spring 18 presses the pinion 3 against the annular gear 11 so that when the internal gear pump 2 is not running, there is no play between the tooth tip 13 of the pinion 3 and the tooth tip 14 of the annular gear 11.

As soon as the engine has reached its idle speed, the pressure inside the gear pump 2 increases and the pinion is pushed away from the annular gear 11 in opposition to the spring force of the second compression spring 18 until it permits the play between the supporting stub 5 and the pinion 3. Consequently, the radial play at the tooth tips 13 and 14 is set to a value greater than zero when the engine is operated for long periods.

The view of the internal gear pump 2 from the left shows an inlet conduit 22 and a delivery conduit 23 in the pump housing, via which the high-pressure pump that is not shown aspirates fuel (not shown). The fuel (not shown) flows through an inlet bore 24 to the inlet conduit 22 and flows out of the delivery conduit 23 into a delivery bore 25.

Figure 3:
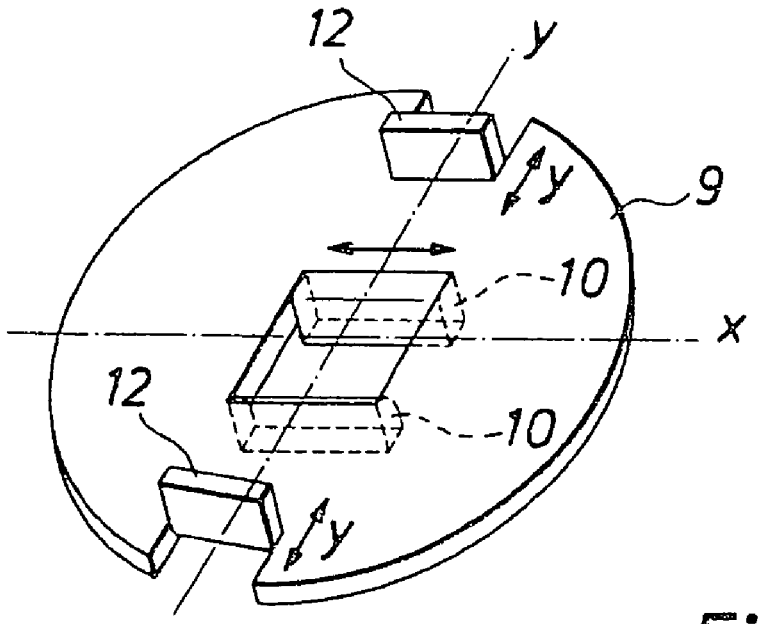
FIGS. 3 and 4 show perspective views of different embodiments of a coupling disk according to the invention.

FIG. 3 shows a perspective view of a first exemplary embodiment of a coupling disk 9 according to the invention. In this exemplary embodiment, the coupling disk 9 is made of a piece of sheet metal. The projections 12 have been produced on the side of the coupling disk 9 oriented toward the top in FIG. 3 by bending two incised sheet metal strips of the coupling disk 9 upward. In this exemplary embodiment, the two-edged element 10, which is only depicted with dashed lines, has been produced by folding two sheet metal strips of the coupling disk 9 downward. Together with the recess 6 of the annular gear 11, not shown in FIG. 3, and the recess 8 in the shaft end 21, also not shown, the coupling disk 9 is permitted to execute compensating movements in the X- and Y-direction, as indicated by the arrows in FIG. 3. This makes it possible to compensate for an axial offset between the rotation axis of the shaft end 21 and the annular gear 11.

Figure 4:
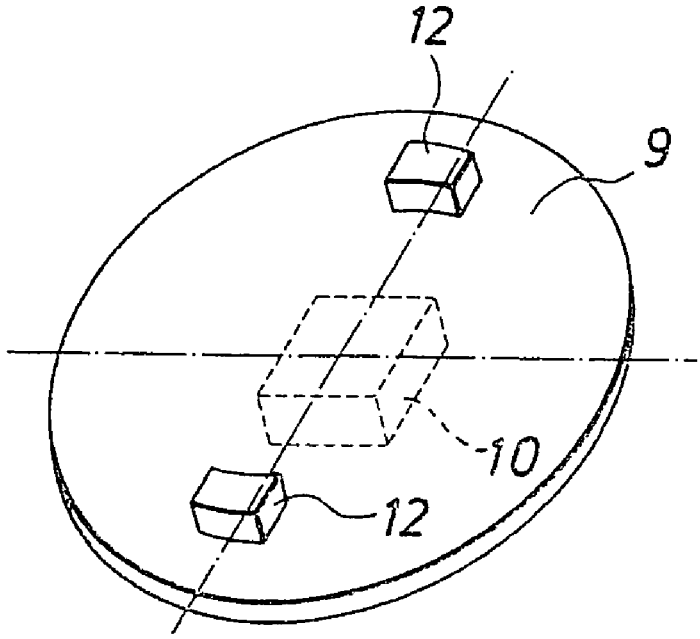

FIG. 4 shows a perspective view of a second exemplary embodiment of a coupling disk 9 according to the invention. The coupling disk 9 is produced, for example, by means of sintering or die-casting. In this exemplary embodiment, the projections 12 and the two-edged element 10 are sintered or die-cast onto the actual coupling disk 9.

The foregoing relates to preferred exemplary embodiments to the invention, it being understood that other variants and embodiments thereof are possible within the spirit and scope of the invention, the latter being defined by the appended claims.

The invention claimed is:

1. An internal gear pump for delivering fuel in an internal combustion engine, the pump comprising, an internally toothed annular gear (11) and an externally toothed pinion (3) cooperating with the annular gear (11) to produce a pumping action, a supporting stub (5) supporting the pinion (3) with radial play to permit limited radial movement of the pinion (3), and eccentric to the annular gear (11), and means for compensating for the radial play between the pinion (3) and the annular gear (11), at least during starting of the internal combustion engine, the means for compensating including a lateral bore (17) in the supporting stub (5) and a compression spring (18) contained in the lateral bore (17), the compression spring (18) being supported at least indirectly against the pinion (3).

2. The internal gear pump according to claim 1, further comprising a thrust piece, including a sphere (19), between the compression spring (18) and the pinion (3).

3. The internal gear pump according to claim 2, further comprising means for adjusting the prestressing force of the compression spring (18).

4. The internal gear pump according to claim 3, further comprising an Oldham coupling (8, 9, 10, 12, 6), including a coupling disc (9), coupling a drive shaft (21) to the annular gear (11).

5. The internal gear pump according to claim 2, further comprising an Oldham coupling (8, 9, 10, 12, 6), including a coupling disc (9), coupling a drive shaft (21) to the annular gear (11).

6. The internal gear pump according to claim 1, further comprising means for adjusting the prestressing force of the compression spring (18).

7. The internal gear pump according to claim 6, further comprising an Oldham coupling (8, 9, 10, 12, 6), including a coupling disc (9), coupling a drive shaft (21) to the annular sear (11).

8. The internal gear pump according to claim 1, further comprising an Oldham coupling (8, 9, 10, 12, 6), including a coupling disc (9), coupling a drive shaft (21) to the annular gear (11).

9. An internal gear pump for delivering fuel in an internal combustion engine, the pump comprising, an internally toothed annular gear (11) and an externally toothed pinion (3) cooperating with the annular gear (11) to produce a pumping action, a supporting stub (5) supporting the pinion (3) with radial play to permit limited radial movement of the pinion (3), and eccentric to the annular gear (11), means for compensating for the radial play between the pinion (3) and the annular gear (11), at least during starting of the internal combustion engine, and an Oldham coupling (8, 9, 10, 12, 6), including a coupling disc (9), coupling a drive shaft (21) to the annular gear (11).

10. The internal gear pump according to claim 9, further comprising a second compression spring (16) pressing the coupling disk (22) against the annular gear (11).

11. The internal gear pump according to claim 10, wherein the second compression spring (16) is disposed inside the shaft end (21).

12. The internal gear pump according to claim 11, wherein the prestressing force of the compression spring (16) is adjustable.

13. The internal gear pump according to claim 10, wherein the prestressing force of the compression spring (16) is adjustable.

* * * * *